United States Patent [19]

Connolly

[11] 4,187,824

[45] Feb. 12, 1980

[54] ELECTRICAL FUEL CUT OFF SWITCH

[76] Inventor: Joseph C. Connolly, 871 SW. 64th. Ave., North Lauderale, Fla. 33063

[21] Appl. No.: 861,634

[22] Filed: Dec. 19, 1977

[51] Int. Cl.[2] ..... F02D 17/00

[52] U.S. Cl. ..... 123/198 F; 123/32 AE; 123/198 DB

[58] Field of Search ..... 123/198 F, 32 EA, 32 AE, 123/198 DC, 198 DB

[56] References Cited

U.S. PATENT DOCUMENTS

| | | | |
|---|---|---|---|
| 2,186,043 | 1/1940 | Rohlin | 123/198 F |
| 2,271,824 | 2/1942 | Johns | 123/198 F |
| 2,745,391 | 5/1956 | Winkler | 123/198 F |
| 2,771,867 | 11/1956 | Peras | 123/198 F |
| 2,875,742 | 3/1959 | Dolza | 123/198 F |
| 3,158,143 | 11/1964 | Heidner | 123/198 F |
| 3,181,520 | 5/1965 | Mock | 123/198 F |

*Primary Examiner*—Ira S. Lazarus
*Attorney, Agent, or Firm*—Malin & Haley

[57] ABSTRACT

An electrical control circuit system for internal combustion engines, either diesel or gasoline engines, for selectively shutting off the fuel supply to certain cylinders while maintaining the other cylinders in operating condition. More particularly, a wire is run from the electrical charge source which supplies a charge to the solenoid valve on each cylinder of a fuel injected engine to a switch on the vehicle dashboard. The wire is then run from said switch to the solenoid valve. For example, half of the engine cylinders are connected to one switch and the other half to another switch so that the operator may shut down either half of the engine's cylinders by flipping one of the side by side switches, thus conserving fuel during periods when maximum horsepower is not required.

2 Claims, 3 Drawing Figures

ELECTRICAL FUEL CUT OFF SWITCH

BACKGROUND OF THE INVENTION

This invention relates to the field of an electronic fuel injections systems and more particularly to such systems for an automotive type internal combustion engine, in which the fuel supplied to certain cylinders can be shut off.

One old device is shown in U.S. Pat. No. 3,889,647 to Rachel. In order to accomplish this partial type of shut down of an engine, without effecting unduly the smoothness of the engine, the shut off means are controlled by various sensors throughout the engine. Said sensors aid in determining engine load and as the load lessens, the cylinders are shut down, or similarly as the load increases the cylinders are activated, see Lindsley, 5-*in*-1 *Engine, Popular Science,* J1 1977 p. 72.

However, the present device has no sensor and the cylinders are shut off manually by the operator by either (1) shutting off the electricity to the fuel injection solenoids for each cylinder, or (2) placing a solenoid valve in the fuel line and shutting off the fuel flow in a line to each cylinder. The particular method depends on the type of engine. Such a device is not disclosed in the prior art or the patent referred to above and desirable results can be achieved in a non-complex manner disclosed in this invention, thus greatly reducing the cost of such cylinder shut down devices.

BRIEF SUMMARY OF THE INVENTION

The internal combustion engines in cars and trucks are called upon to generate different amounts of horsepower depending on such factors as whether the vehicle is accelerating, maintaining a constant speed, decelerating, or going up or down on decline. The amount of displacement is related to the horsepower that can be generated by the engine. But just as greater displacement means greater horsepower, it means greater fuel consumption. Engines are created which have large displacements so that they will be able to generate sufficient horsepower to deliver the desired acceleration. Since a large displacement is needed for some stressful situations, the engine's large displacement wastes fuel during normal running. The present invention was developed in order to obtain the benefits of high horsepower from large displacement and fuel economy from small displacement from the same engine.

The present invention comprises a means for selectively cutting off the fuel supply to half the cylinders of an engine and thus reducing the fuel consumption and the potential horsepower of a fuel injected engine. In a fuel injected engine an electrically power source supplies power to the solenoid valve on the fuel line to each cylinder to allow pressurized fuel from the pump to be injected into the cylinder. As each solenoid is electrically activated it injects fuel into its cylinder. The solenoids of course are activated sequentially to match the firing order of the engine. In the present invention the firing order is determined and the wires supplying electricity to every other solenoid in the firing order is led to a switch on the vehicle's dashboard, and from the switch to its respective solenoid. Similarly, the remaining wires which supply electricity to the other half of the engine's solenoids are led to another switch, placed alongside the first switch, on the vehicle's dashboard and then to their respective solenoids. When both the switches are closed all the solenoids are activated in sequence and the engine runs as it normally would with maximum potential horsepower and maximum fuel consumption. However, when the vehicle's operator has obtained the desired cruising speed he may open either of the switches. When a switch is opened, the electrical power to half the car's solenoids is cut off. The effect is to cut off the fuel supply to half the cylinders, reduce the engine's fuel consumption and potential horsepower. When the vehicle is going downhill it is possible to open both switches thus completely cutting off the engine's fuel; this of course eliminates all horsepower from the engine but since the pistons still move within the cylinders the braking effect of the engine is maintained.

In accordance with the above described structure and operation it is the primary object of this invention to provide a means for reducing the fuel consumption of an internal combustion engine.

Another object is to provide a means for selectively cutting off the fuel supply to either half of the cylinders of an internal combustion engine from the driver's position in the auto.

Another object is to provide two side-by-side switch means which can be manually operated from within the vehicle.

Still another object is to provide to such a means which can be easily and economically installed.

These and other objects and advantages will become apparent to those skilled in the art upon reading the disclosure of the structure and operation as set forth below with particular reference to the accompanying drawing wherein like numerals refer to like parts throughout.

DETAILED DESCRIPTION OF PREFERRED EMBODIMENTS

Figure 1:
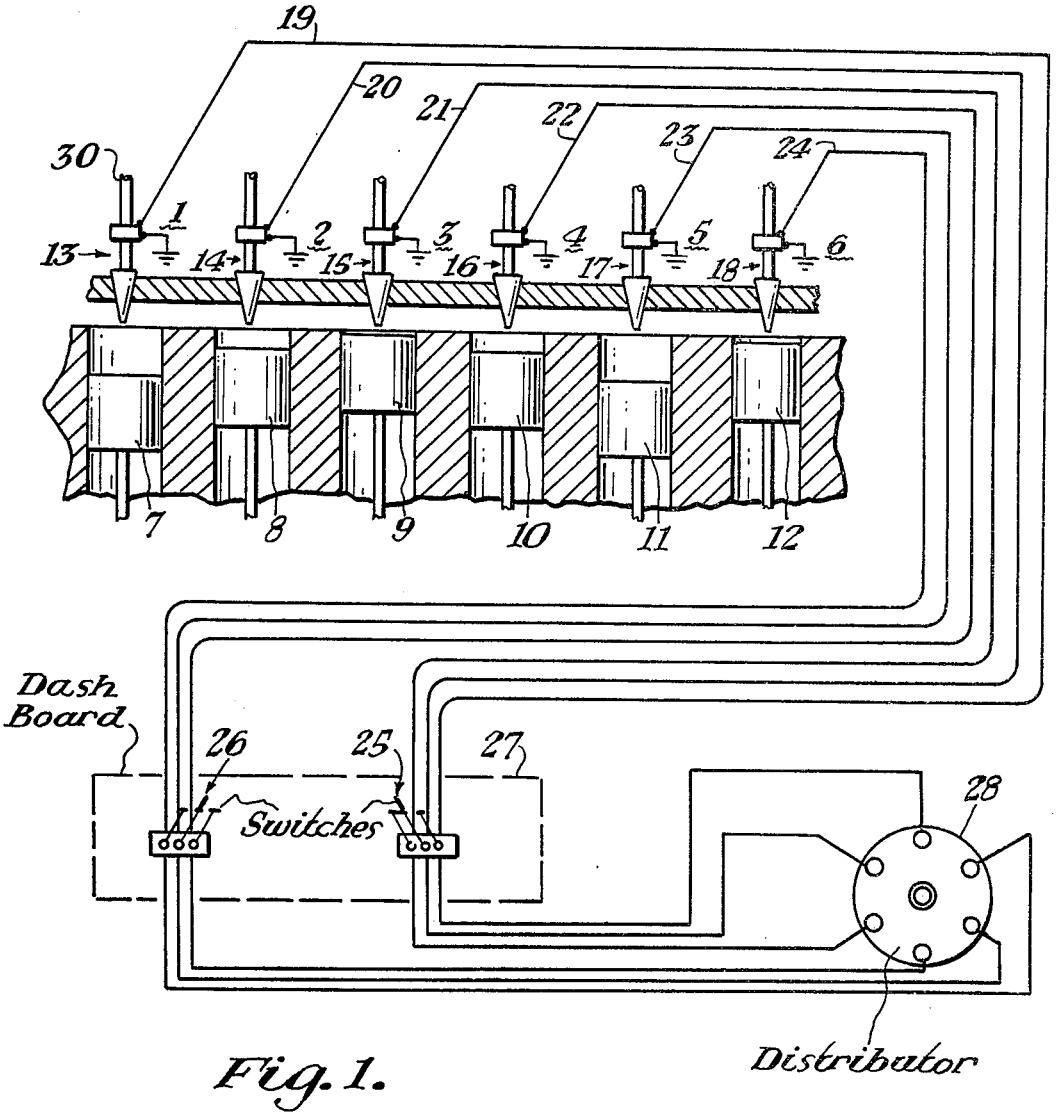
FIG. 1 is a schematic drawing of the device as connected to a fuel injected internal combustion engine with six cylinders.

Referring now to the drawing, the device is shown installed within the electrical system of a six cylinder fuel injected internal combustion engine. The cylinders 1, 2, 3, 4, 5 and 6 are shown with pistons 7, 8, 9, 10, 11 and 12, respectively, within the cylinders. The fuel injection solenoid valves 13, 14, 15, 16, 17 and 18 are shown connected to their respective cylinders. The wires 19, 20 and 21 lead from valves 13, 14 and 15 respectively through firewall 27 to switch bank 25 and then continue on back through firewall 27 to distributor 28. The distributor 28 supplies power to each of the valves at different times so that the firing order of the engine is 1, 5, 3, 6, 2, 4; the typical firing order in most six cylinder engines. Similarly, the wires 22, 23 and 24 lead from valves 16, 17 and 18 respectively through firewall 27 to switch bank 26 and then continue on back through firewall 27 to distributor 28.

Switches 25 and 26 are mounted on the dashboard of the vehicle within easy reach of the driver. When both switches 25 and 26 are open as shown in FIG. 1, no electricity is being supplied to any of the valves 13–18, thus no fuel is being delivered to any of cylinders 1-6. If both switches 25 and 26 are closed, the engines operate normally with power being supplied sequentially to each of the valves so that the 1, 5, 3, 6, 2, 4 firing order is maintained. When switch 25 is open and switch 26 is closed the cylinders 1, 2, and 3 will receive no fuel but since the firing order of the cylinders is maintained there will be no charge to explode in 1, an explosion in 5, no charge in 3, an explosion in 6, no charge in 2, and an explosion in 4. Thus effective firing order is 5, 6, 4. If the 25 is closed and switch 26 is open, the effective firing order is 1, 3, 2. Most engines can supply sufficient power to their respective vehicles while operating on half their cylinders while the vehicle is moving on level ground and is not accelerating.

Obviously this method can be expanded to engines with different numbers of cylinders than six. It should be kept in mind that the invention is most effective when the switches are connected so that half of the cylinders are deactivated when one of the switches is opened. The firing order should also be considered so that every other cylinder is deactivated when one switch is open.

Obviously this invention must be altered somewhat in order to be adaptable to an engine without fuel injection that has two carburetors each feeding half of the engine. To work in such an engine, solenoid operated valves must be placed in the inlet fuel line to each carburetor of the engine so that fuel input may be selectively blocked from reaching either half of the cylinders. It has been found that the invention is far easier to install and more effective in accomplishing its desired objectives when applied to a fuel injected engine.

For example, in a 1977 Datsun 810 auto the auto has a separate distributor that activates the solenoid valve on each fuel line leading to each cylinder. Each of three electrical lines to solenoid valves may be cut and one side connected to one side of a switch on the dashboard and the other side connected to the other side of the switch on the dashboard. The other three electrical lines are connected to a second switch. The first and second switches are set to control a balanced turnoff of particular cylinders, such as first switch will control cylinders 1, 2 and 3, and the second switch will control cylinders 4, 5 and 6. This keeps the engine running on either switch 1 or 2 in a balanced condition.

Also for example, in engines not having solenoid valves, solenoid valves will be inserted on each fuel line to each cylinder. It will be controlled as set forth in the example above.

Figure 3:
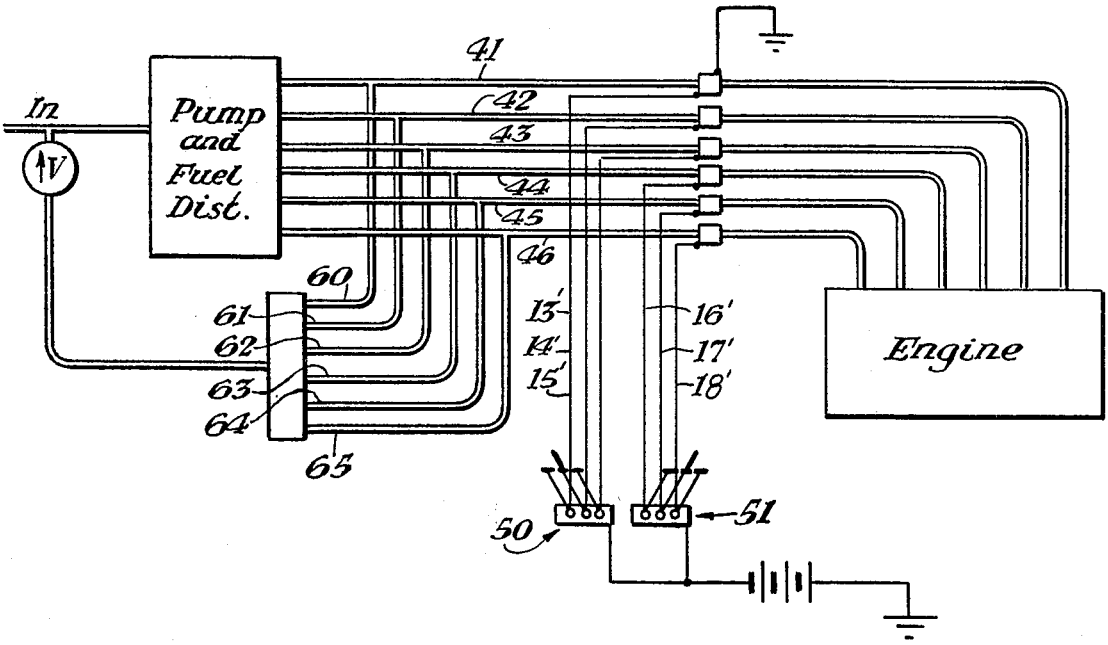
FIG. 3 is a schematic drawing of installation of solonoid shut off means in a pump and fuel distributor engine system; such as in a present engine.

In a third example, in a diesel engine as shown in FIG. 3, you will install solenoid valves, such as 13', 14', 15', 16', 17' and 18' in the fuel lines 41, 42, 43, 44, 45, and 46, and electrical control switches 50 and 51 similar to switches 25 and 26 as set forth above. Each solenoid valve may include a relief means shown as 61, 62, 63, 64, 65, and 66 to discharge fuel from the lines into a low pressure fuel area to prevent excess pressure in the line when closed.

Therefore, all switches may be on to operate the vehicle normally; the first switch may be off and the second switch on to operate the vehicle on cylinders 4, 5 and 6. For example, on a six-cylinder vehicle, the first switch may be on and the second switch may be off to operate the vehicle on cylinders 1, 2 and 3; or both switches may be off to conserve fuel going down a grade.

This invention may be installed on a rotary engine.

Figure 2:
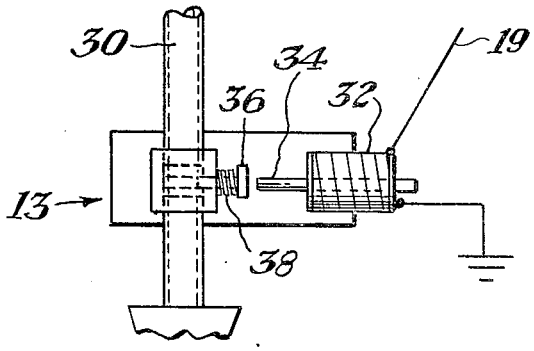
FIG. 2 is an enlarged side view of a solenoid valve means.

As shown in FIG. 2, fuel line 30 is connected to a piston cylinder. The coil is operated to actuate the core member 34 to operate valve 36 that closes off the fuel line. The spring 38 returns the valve to an open position.

The instant invention has been shown and described herein in what is considered to be the most practical and preferred embodiments. It is recognized, however, that departures may be made therefrom within the scope of the invention and that obvious modifications will occur to a person skilled in the art.

What I claim is:

1. In a fuel injected internal combustion engine in a vehicle with a control board adjacent the driver, the injected internal combustion engine including solenoid valves distributing fuel under pressure to the engine cylinders of the internal combustion engine which engine cylinders have a prescribed firing order, at least one solenoid valve connected to each engine cylinder, the solenoid valves and the engine cylinders are divided into at least a first bank and a second bank of different solenoid valves and engine cylinders, and the injected internal combustion engine includes a solenoid valve control distributor with electrical lines connecting said distributor between the solenoid valves and the electric power, said distributor sequentially supplies electrical power to each solenoid valve for opening and closing each solenoid valve, a manual switching device for the driver that is easily and selectively used to cut off fuel to each particular bank of different solenoid valves and engine cylinders comprising:

a plurality of manual switching means including at least a first manual switching means and a second manual switching means for disconnecting and connecting electrical power to said solenoid valves, said switching means for controlling fuel to the engine cylinders and placement adjacent the driver for manual operation by the driver, said switching means connected in said electric lines, said first manual switching means for connecting and disconnecting electrical power in said electrical lines connected solely to said first bank to prevent fuel flow, and said second switching means for connecting and disconnecting electrical power in said electrical lines connected solely to said second bank to prevent fuel flow, a first electrical connecting means for separately connecting said solenoid valves in said first bank to said distributor solely through said first switching means, and a second electrical connecting means for separately connecting said solenoid valves in said second bank to said distributor solely through said second switching means, whereby the fuel to said first bank of engine cylinders is controlable separately and apart from the fuel to said second bank of engine cylinders.

2. A device for selectively cutting off fuel to engine cylinders as recited in claim 1 in a six cylinder engine having cylinders 1, 2, 3, 4, 5, and 6, wherein:

said first switching means and said second switching means are mounted on the dashboard of the vehicle adjacent the driver of the vehicle in which said device is installed, said first bank of said solenoid valves are connected to cylinders 1, 2 and 3, and said second bank of said solenoid valves are connected to cylinders 4, 5 and 6.

* * * * *